US010156807B2

(12) United States Patent
Tsujioka

(10) Patent No.: US 10,156,807 B2
(45) Date of Patent: Dec. 18, 2018

(54) OPTICAL SCANNING DEVICE AND IMAGE FORMING APPARATUS

(71) Applicant: KYOCERA Document Solutions Inc., Osaka (JP)

(72) Inventor: Koji Tsujioka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/956,923

(22) Filed: Apr. 19, 2018

(65) Prior Publication Data

US 2018/0314183 A1 Nov. 1, 2018

(30) Foreign Application Priority Data

Apr. 27, 2017 (JP) ..... 2017-088739

(51) Int. Cl.
*G03G 15/04* (2006.01)
*B41J 2/44* (2006.01)

(52) U.S. Cl.
CPC ..... *G03G 15/0409* (2013.01); *B41J 2/442* (2013.01)

(58) Field of Classification Search
CPC ..... G03G 15/011
See application file for complete search history.

(56) References Cited

U.S. PATENT DOCUMENTS 6,705,430 B2 * 3/2004 Michioka ..... B23Q 11/0875 184/5
8,831,468 B2 * 9/2014 Yuki ..... G03G 21/00 347/224
9,115,786 B2 * 8/2015 Mizuno ..... F16H 55/17

FOREIGN PATENT DOCUMENTS

JP 2009169133 A * 7/2009
JP 2010-091690 4/2010

* cited by examiner

*Primary Examiner* — Clayton E Laballe
*Assistant Examiner* — Leon W. Rhodes, Jr.
(74) *Attorney, Agent, or Firm* — Wenderoth, Lind & Ponack, L.L.P.

(57) ABSTRACT

From an upper surface of a housing of an optical scanning device, a plate-like rail part, which extends along a screw shaft to guide movement of a holding member, protrudes, and the holding member is provided with a guide part having a guide groove engaged with the rail part. The optical scanning device further includes scraper members fixed to the holding member and scraping off foreign matters attached to the rail part. On side surfaces of the housing, which face a moving end side, collection cases are provided to collect the foreign matters scraped off by the scraper members.

4 Claims, 13 Drawing Sheets

OPTICAL SCANNING DEVICE AND IMAGE FORMING APPARATUS

CROSS-REFERENCE TO RELATED APPLICATION

This application is based upon and claims the benefit of priority from Japanese Patent Application No. 2017-088739 filed on Apr. 27, 2017, the entire contents of which are incorporated herein by reference.

BACKGROUND

The technology of the present disclosure relates to an optical scanning device and image forming apparatus.

An image forming apparatus employing an electrophotographic system such as a copy machine and a printer includes an optical scanning device that emits light for forming an electrostatic latent image on a photoreceptor.

The optical scanning device has a housing that receives a polygon mirror, an image forming lens and the like. The housing is formed with light emitting ports that emit light. The light emitting port includes an opening extending in a predetermined direction. The light emitting port is closed by a transparent cover such as a dustproof glass.

However, when dirt, dust and the like due to toner and the like are attached to the surface of the transparent cover, there is a problem that the optical characteristics of the optical scanning device are deteriorated and thus image failure occurs. In this regard, there has been proposed a cleaning mechanism that regularly cleans the surface of the dustproof glass.

The cleaning mechanism has a screw shaft extending along the transparent cover, and a holding member screwed with the screw shaft to hold a cleaning member.

The holding member has a cylindrical nut part screwed with the screw shaft, and an arm part that extends from the nut part in a direction crossing the screw shaft and holds the cleaning member. The nut part is provided on the inner peripheral surface thereof with a protrusion part that engages with a spiral groove formed on the outer peripheral surface of the screw shaft. The spiral groove of the outer peripheral surface of the screw shaft and the protrusion part of the inner peripheral surface of the nut part are engaged with each other and the screw shaft is rotated, so that the holding member moves along the screw shaft. The holding member reciprocally moves along a predetermined movement path when a motor is rotated forward and backward. By so doing, the cleaning member reciprocally moves while abutting the surface of the transparent cover, so that the surface of the transparent cover is cleaned by the cleaning member.

SUMMARY

An optical scanning device according to one aspect of the present disclosure includes a housing, a transparent cover, a screw shaft, a cleaning member, and a holding member. The housing has light emitting ports. The transparent cover closes the light emitting ports. The screw shaft extends along the transparent cover and is configured to freely rotate. The cleaning member abuts a surface of the transparent cover. The holding member has a nut part and arm parts. The nut part is screwed with the screw shaft. The arm parts extend from the nut part to hold the aforementioned cleaning member. The holding member reciprocally moves along a predetermined movement path by rotation of the aforementioned screw shaft.

From an upper surface of the aforementioned housing, a plate-like rail part protrudes. The rail part extends along the screw shaft to guide movement of the holding member. The holding member is provided with a guide part. The guide part has a guide groove engaged with the rail part. The optical scanning device further includes scraper members. The scraper members are provided to both side end parts in a movement direction in the guide part of the holding member. The scraper members scrape off foreign matters attached to the aforementioned rail part. In the housing, on side surfaces of the holding member, which face a moving end side, collection cases are provided. The collection cases are provided at positions of the side surfaces corresponding to the scraper members. The collection cases collect the foreign matters scraped off by the scraper members.

DETAILED DESCRIPTION

Hereinafter, an example of an embodiment will be described in detail on the basis of the drawings. It is noted that the technical scope of the present disclosure is not limited to the following embodiments.

Embodiment

Figure 1:
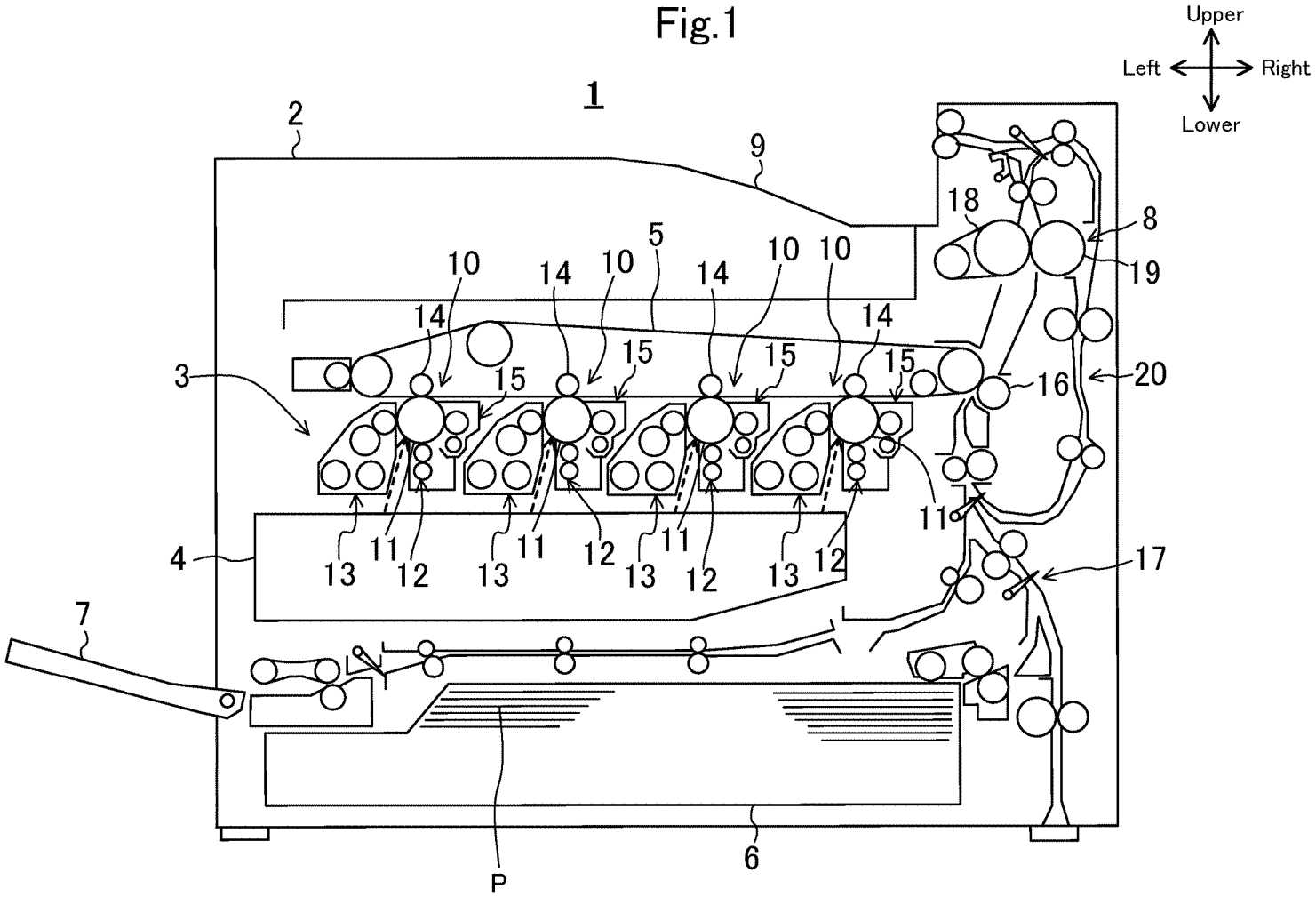
FIG. 1 is a schematic diagram illustrating an overall configuration of an image forming apparatus provided with an optical scanning device in an embodiment.

FIG. 1 illustrates a schematic configuration diagram of an image forming apparatus 1 according to an embodiment of the present invention. In the following description, it is assumed that a front side and a rear side indicate a front side and a rear side (a front side and a back side in a direction vertical to the paper surface of FIG. 1) of the image forming apparatus 1, and a left side and a right side indicate a left side and a right side when the image forming apparatus 1 is viewed from the front side.

The image forming apparatus 1 is a tandem type color printer and includes an image forming unit 3 in a box-like casing 2. The image forming unit 3 transfers an image to a recording paper P and forms the image on the recording paper P on the basis of image data transmitted from an external device such as a computer subjected to network connection and the like. Below the image forming unit 3, an optical scanning device 4 is arranged to irradiate laser light, and above the image forming unit 3, a transfer belt 5 is arranged. Below the optical scanning device 4, a paper storage unit 6 is arranged to store the recording paper P, and at the left side of the paper storage unit 6, a manual paper feeding unit 7 is arranged. At a right upper part of the transfer belt 5, a fixing unit 8 is arranged to perform a fixing process on the image transferred to and formed on the recording paper P. A reference numeral 9 indicates a paper discharge unit arranged at an upper part of the casing 2 to discharge the recording paper P subjected to the fixing process in the fixing unit 8.

The image forming unit 3 includes four image forming units 10 arranged in a row along the transfer belt 5. Each of the image forming units 10 has a photosensitive drum 11. Directly under each photosensitive drum 11, a charging device 12 is arranged, and at the left side of each photosensitive drum 11, a developing device 13 is arranged. Directly above each photosensitive drum 11, a primary transfer roller 14 is arranged, and at the right side of each photosensitive drum 11, a cleaning unit 15 is arranged to clean the peripheral surface of the photosensitive drum 11.

The peripheral surface of each photosensitive drum 11 is uniformly charged by the charging device 12, and laser light corresponding to each color based on the image data inputted from the aforementioned computer and the like is irradiated to the charged peripheral surface of each photosensitive drum 11 from the optical scanning device 4, so that an electrostatic latent image is formed on the peripheral surface of each photosensitive drum 11. A developer is supplied to the electrostatic latent image from the developing device 13, so that a toner image of yellow, magenta, cyan, or black is formed on the peripheral surface of each photosensitive drum 11. These toner images are respectively superposed on and transferred to the transfer belt 5 by a transfer bias applied to the primary transfer roller 14.

A reference numeral 16 indicates a secondary transfer roller arranged below the fixing unit 8 in the state of abutting the transfer belt 5, wherein the recording paper P conveyed along a paper conveyance path 17 from the paper storage unit 6 or the manual paper feeding unit 7 is interposed between the secondary transfer roller 16 and the transfer belt 5, and the toner images on the transfer belt 5 are transferred to the recording paper P by a transfer bias applied to the secondary transfer roller 16.

The fixing unit 8 includes a heating roller 18 and a pressure roller 19, wherein the recording paper P is interposed by the heating roller 18 and the pressure roller 19 so as to be pressed and heated, so that the toner images, which have been transferred to the recording paper P, are fixed to the recording paper P. The recording paper P subjected to the fixing process is discharged to the paper discharge unit 9. A reference numeral 20 indicates a reversing conveyance path for reversing the recording paper P discharged from the fixing unit 8 at the time of duplex printing.

Figure 2:
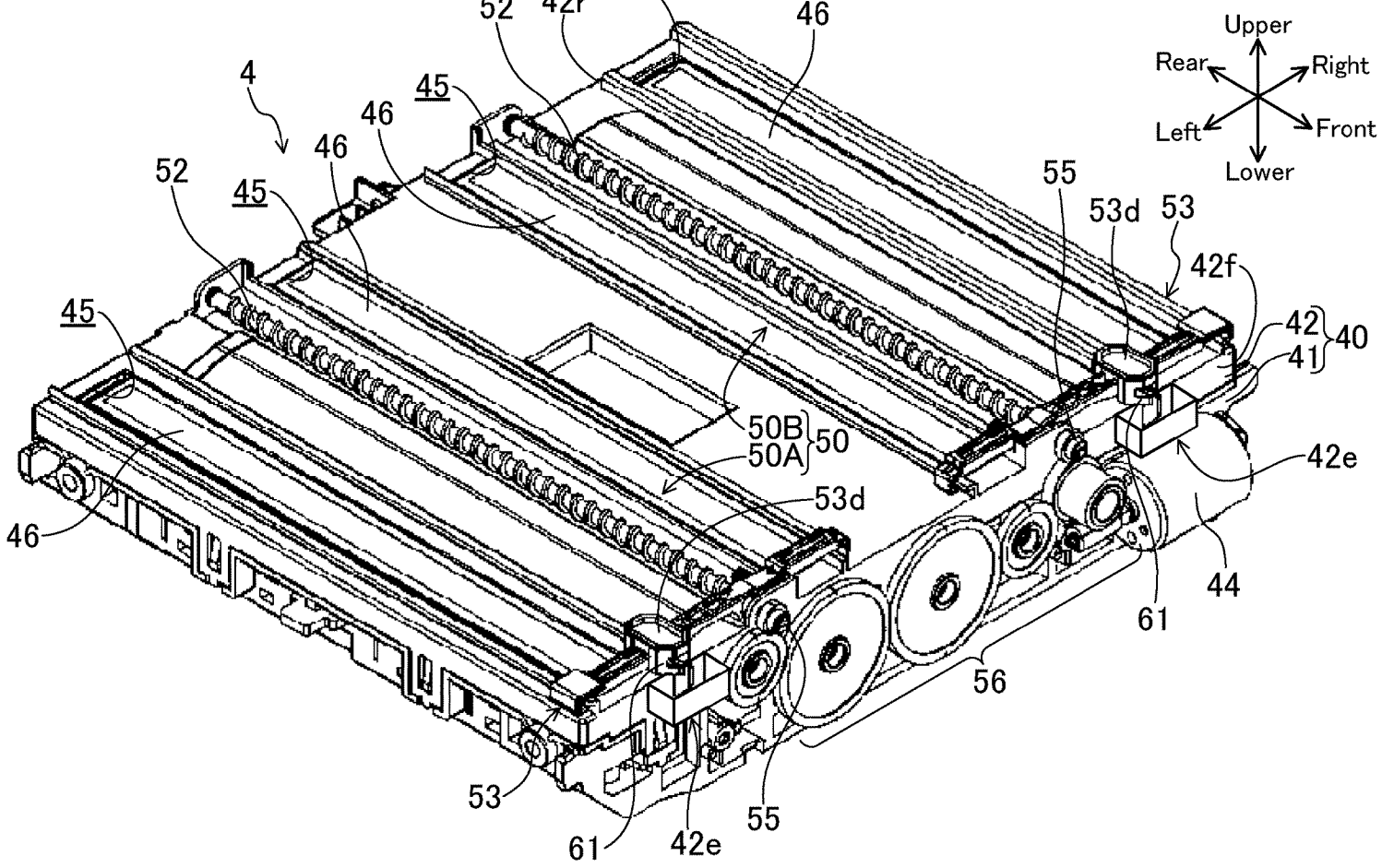
FIG. 2 is an external appearance perspective view of an optical scanning device.

FIG. 2 is an external appearance perspective view of the optical scanning device 4. The optical scanning device 4 includes a sealed box-like housing 40. The housing 40 includes a bottomed box-like housing body 41 in which a ceiling side is opened, and a lid member 42 that closes the ceiling side of the housing body 41.

Figure 3:
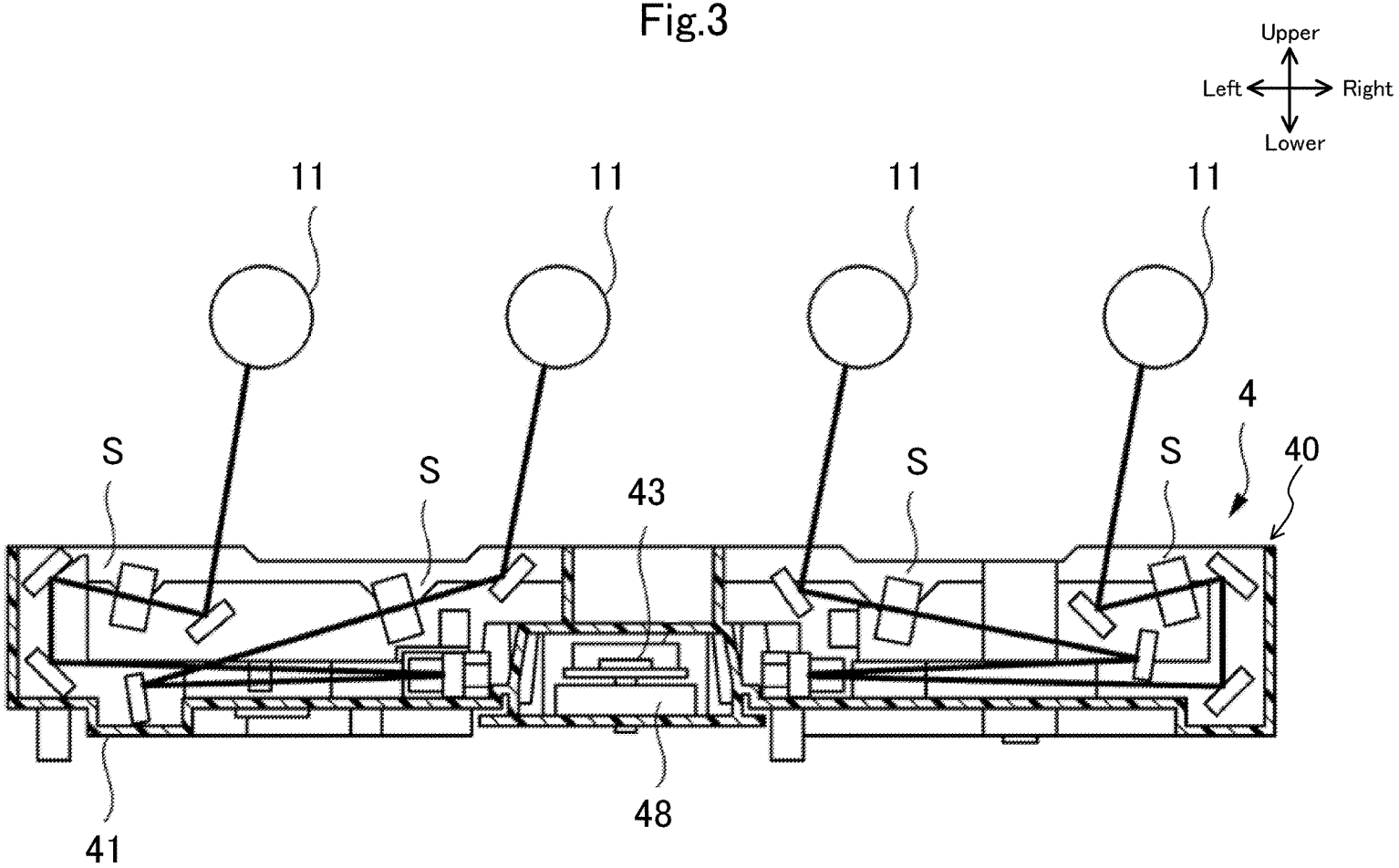
FIG. 3 is a schematic diagram illustrating an internal structure of a housing body of an optical scanning device.

FIG. 3 is a sectional view illustrating a state in which the lid member 42 has been detached from the housing 40 of the optical scanning device 4. At a center part of a bottom wall of the housing body 41, a polygon mirror 43 and a driving motor 44 for rotationally driving the polygon mirror 43 are arranged. The polygon mirror 43 deflects and scans laser light for electrostatic latent image writing, which is emitted from a light source and corresponds to each color of magenta (M), cyan (C), yellow (Y), and black (K). At the bottom wall of the housing body 41, two pairs of scanning optical systems S, that is, total four scanning optical systems S are arranged at both sides of the polygon mirror 43 while interposing the polygon mirror 43 therebetween. The four scanning optical systems S guide the laser light, which corresponds to each color of the magenta (M), the cyan (C), the yellow (Y), and the black (K), to the surface of the surface of each photosensitive drum 11. Each of the scanning optical systems S, for example, is configured by a fθ lens, a reflecting mirror and the like.

As illustrated in FIG. 2, the lid member 42 is formed with two sets of (total four) light emitting ports 45 through which the laser light emitted from the scanning optical systems S passes, wherein one set of light emitting ports 45 form a pair. Each light emitting port 45 includes a rectangular opening extending in a main scanning direction (a front and rear direction). The light emitting ports 45 are formed in parallel with one another in a right and left direction. Each light emitting port 45 is covered by a transparent cover 46 for dustproof that allows light to pass therethrough. Each transparent cover 46 covering each light emitting port 45 is formed in a rectangular plate shape long in the main scanning direction. The surface of each transparent cover 46 is automatically cleaned by an automatic cleaning mechanism 50.

The automatic cleaning mechanism 50 has a first automatic cleaning part 50A and a second automatic cleaning part 50B. The first automatic cleaning part 50A and the second automatic cleaning part 50B are symmetrically arranged while interposing a center position of the housing 40 in the longitudinal direction (the right and left direction) of the housing 40. The first automatic cleaning part 50A cleans two transparent covers 46 through which the laser light of the yellow (Y) and the black (K) passes. The second automatic cleaning part 50B cleans two transparent covers 46 through which the laser light of the magenta (M) and the cyan (C) passes. The first automatic cleaning part 50A and the second automatic cleaning part 50B are driven by one common driving motor 44.

Figure 4:
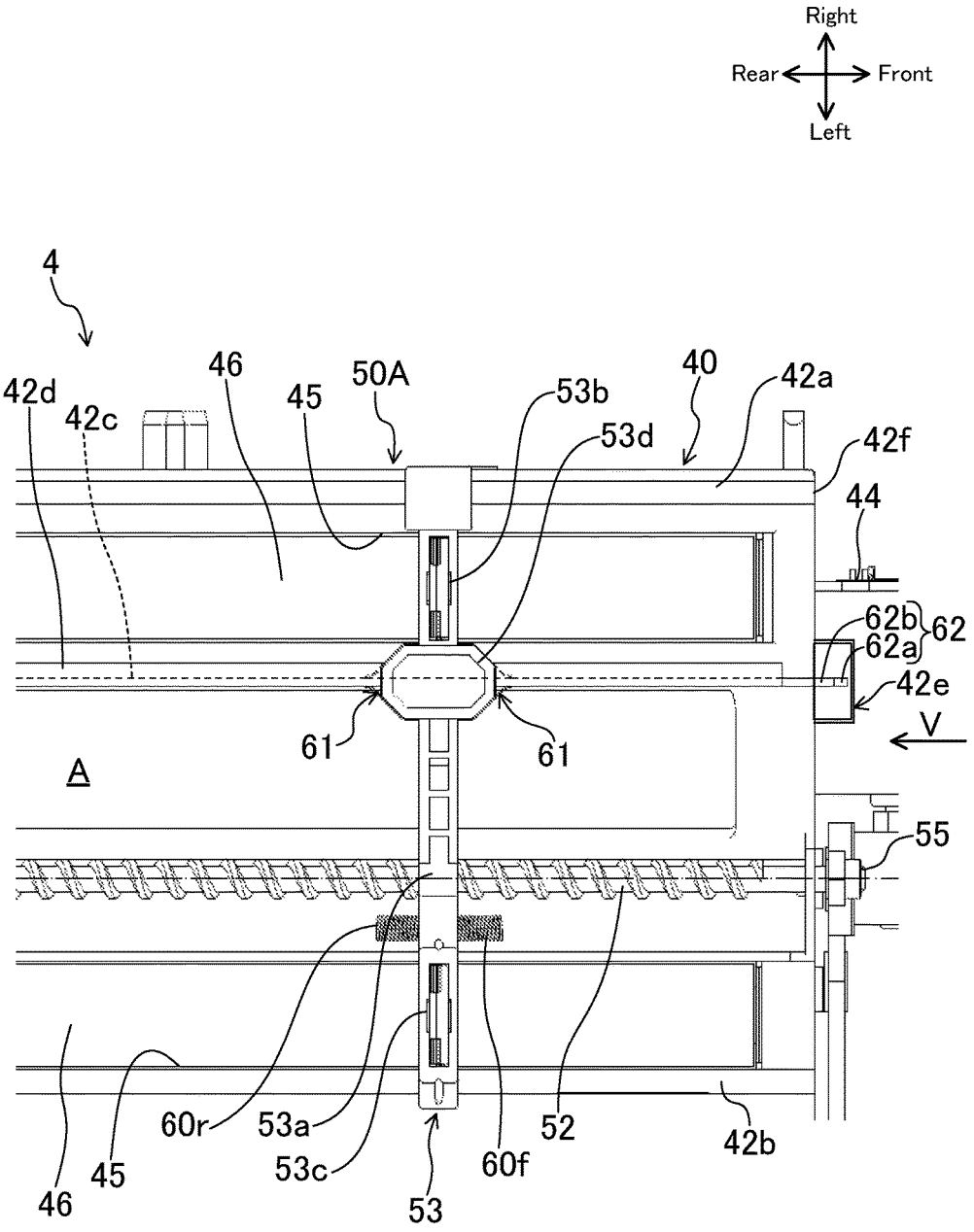
FIG. 4 is a plan view illustrating a state in which a holding member of an automatic cleaning part exists in an intermediate part of a movement path.

Since the first automatic cleaning part 50A and the second automatic cleaning part 50B have the same configuration, only the first automatic cleaning part 50A will be described below with reference to FIG. 4 and FIG. 5 and a description of the second automatic cleaning part 50B will be omitted.

The first automatic cleaning part 50A has a screw shaft 52 arranged between a pair of light emitting ports 45 to freely rotate, a holding member 53 reciprocally driven by the screw shaft 52, and a pair of cleaning members 51 (illustrated only in FIG. 5) held by the holding member 53.

The screw shaft 52 is arranged so as to extend in the front and rear direction. The screw shaft 52 is formed on the outer peripheral surface thereof with a spiral groove. Both end parts of the screw shaft 52 in an axial direction (the front and rear direction) are supported to be rotatable to a bearing part (not illustrated) provided to the lid member 42 of the housing 40. The screw shaft 52 is mounted at one end part thereof with a driving gear 55. The driving gear 55 is connected to the driving motor 44 via a gear train 56 supported to the side wall surface of the housing body 41. The driving motor 44 is mounted on the front side surface of the housing 40, and the screw shaft 52 is driven by the driving motor 44.

The holding member 53 has a nut part 53*a*, a first arm part 53*b*, a second arm part 53*c*, and a guide part 53*d*.

The nut part 53*a* forms an approximately cylindrical shape and is fitted to and is screwed with the screw shaft 52. Specifically, the nut part 53*a* is provided on the inner peripheral surface thereof with a spiral protrusion part which is screwed with a spiral groove of the outer peripheral surface of the screw shaft 52. The screw shaft 52 is arranged at a position offset to one side (the left side in the present embodiment) with respect to the center position in the longitudinal direction of the holding member 53 in the plan view.

The first arm part 53*b* extends rightward (one light emitting port 45 side) from an upper end part of the nut part 53*a*, and the second arm part 53*c* extends rightward (the other light emitting port 45 side) from the upper end part of the nut part 53*a*. The first arm part 53*b* and the second arm part 53*c* are arranged on the same straight line extending in the right and left direction when viewed from an upper side. A length from a proximal end to a distal end of the first arm part 53*b* is longer than that from a proximal end to a distal end of the second arm part 53*c*.

The first arm part 53*b* and the second arm part 53*c* are mounted at the lower surfaces thereof with the cleaning members 51, respectively. The first arm part 53*b* is provided at the intermediate part in the longitudinal direction thereof with the guide part 53*d* to be described later. The second arm part 53*c* is mounted at the front side surface and the rear side surface thereof with compression coil springs 60*f* and 60*r* (see FIG. 4), respectively. The compression coil springs 60*f* and 60*r* have a function of pushing back the holding member 53 and allowing the nut part 53*a* to be reliably engaged with the spiral groove of the screw shaft 52 when the holding member 53 has reached a moving end of a movement path A.

Each cleaning member 51 (see FIG. 5) is formed by an elastic blade member (for example, a silicon pad). The cleaning members 51 are provided at positions corresponding to a pair of transparent covers 46 to be cleaned by the automatic cleaning parts 50A and 50B. That is, each cleaning member 51 is provided at a position overlapping each transparent cover 46 in the plan view. Each cleaning member 51 is interposed between the arm parts 53*b*, 53*c* and the transparent cover 46 and is compressed with a light load in a thickness direction. By so doing, each cleaning member 51 is pressed to the transparent cover 46 at a predetermined pressing force.

When the automatic cleaning mechanism 50 operates, the screw shaft 52 is rotationally driven in both forward and backward directions by the driving motor 44. By so doing, the holding member 53 reciprocally moves along the predetermined movement path A.

Next, with reference to FIG. 2 and FIG. 4 to FIG. 6, a guide structure of the holding member 53 will be described in detail. The holding member 53 is guided by a first rail part 42*a*, a second rail part 42*b*, and an intermediate rail part 42*c* protruding from an upper surface of the lid member 42 of the housing 40. The rail parts 42*a* to 42*c* are formed over approximately the whole of the lid member 42 in the front and rear direction. The rail parts 42*a* to 42*c* are integrally formed with the lid member 42

The first rail part 42*a* and the second rail part 42*b* form a sectional L shape when viewed from the movement direction of the holding member 53. The first rail part 42*a* guides a distal end part of the first arm part 53*b* of the holding member 53 to regulate its position in the up and down direction. The distal end part of the first arm part 53*b* forms a sectional channel shape and is engaged with a horizontal plate part of the first rail part 42*a*. The second rail part 42*b* guides a distal end part of the second arm part 53*c* of the holding member 53 to regulate its position in the up and down direction. The distal end part of the second arm part 53*c* forms a sectional channel shape and is engaged with a horizontal plate part of the second rail part 42*b*.

The intermediate rail part 42*c* is provided between the first rail part 42*a* and the second rail part 42*b*. The intermediate rail part 42*c* is a plate-like part vertically installed on the upper surface of the lid member 42. The intermediate rail part 42*c* is engaged with a guide groove 53*e* (see FIG. 6) of the guide part 53*d* provided to the holding member 53, and regulates its position in the right and left direction. A horizontal plate-like regulating part 42*d* is connected to an upper end part of the intermediate rail part 42*c*. The regulating part 42*d* is provided over the whole of the intermediate rail part 42*c* in the longitudinal direction, and regulates upward movement of the guide part 53*d*.

As illustrated in FIG. 7 to FIG. 10, the guide part 53*d* forms a hexagonal columnar shape long in the movement direction (that is, the front and rear direction) of the holding member 53. A length in the front and rear direction of the guide part 53*d* is longer than that in the front and rear direction of the first arm part 53*b* and the second arm part 53*c*. The guide groove 53*e* is formed over the whole of the guide part 53*d* in the front and rear direction. An upper end of the guide groove 53*e* communicates with a hollow part 53*f* (see FIG. 6) passing through the guide part 53*d* in the front and rear direction. The hollow part 53*f* is a flat rectangular columnar space. The regulating part 42*d* of the intermediate rail part 42*c* abuts a lower surface of the hollow part 53*f*, so that the upward movement of the guide part 53*d* is regulated. Both end parts in the front and rear direction of the guide part 53*d* are formed by a vertical surface 53*g* (see FIG. 8 and FIG. 10) vertical to the movement direction of the holding member 53 and a pair of inclined surfaces 53*h* positioned at both right and left sides while interposing the vertical surface 53*g* therebetween.

The guide part 53*d* is mounted at both end parts in the front and rear direction thereof with scraper members 61 for preventing foreign matters (for example, magnetic toner serving as a developer) from infiltrating into the guide groove 53*e*. At positions corresponding to the scraper members 61 on a front side surface 42*f* and a rear side surface 42*r* of the lid member 42, collection cases 42*e* are respectively provided to collect foreign matters scraped off by the scraper members 61. Details of the collection cases 42*e* will be described later.

Figure 7:
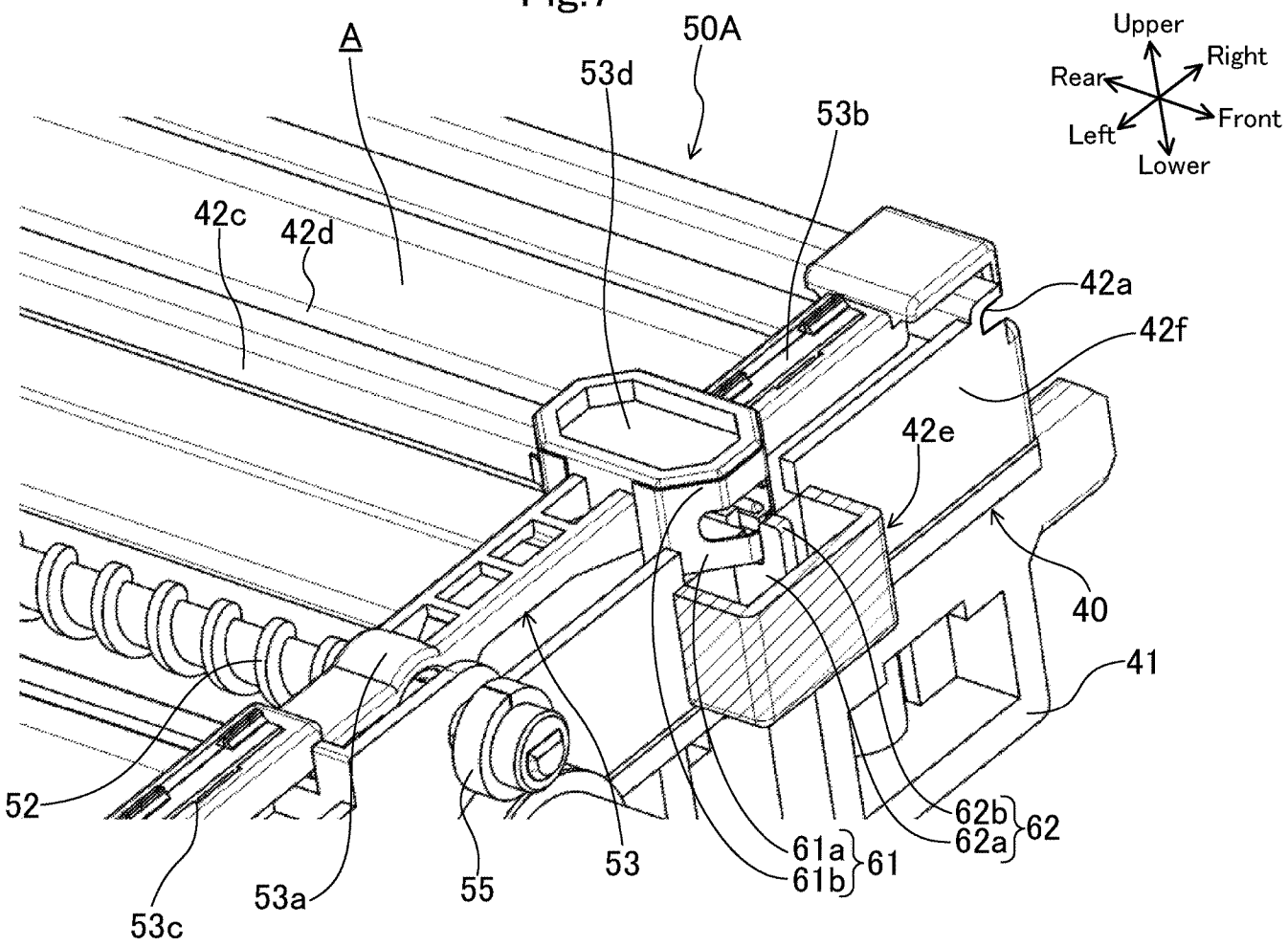
FIG. 7 is a perspective view illustrating a state in which a holding member has reached a moving end in an optical scanning device.

As illustrated in FIG. 7, the scraper member 61 has a pair of scraper pieces 61*a* that scrape foreign matters (toner and the like) attached to a side surface of the intermediate rail part 42*c*, and a connection piece 61*b* that connects the pair of scraper pieces 61*a* to each other. The scraper member 61 includes a flexible member such as a PET film and rubber.

Figure 8:
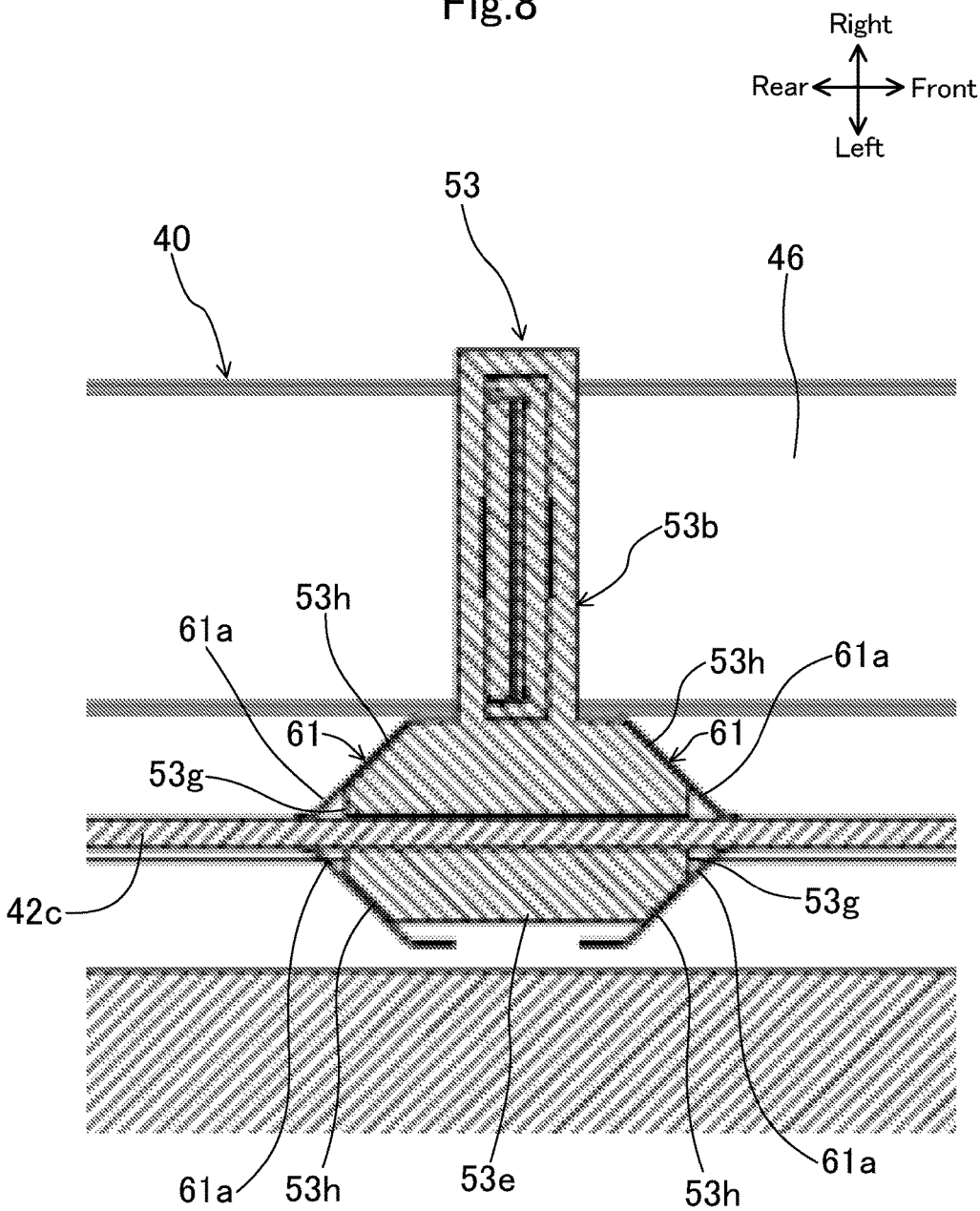
FIG. 8 is a sectional view taken along line VIII-VIII of FIG. 5.
Figure 9:
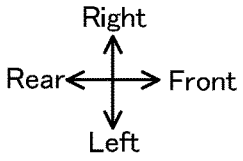
FIG. 9 is a plan view illustrating a state in which a holding member of an automatic cleaning part has reached a moving end of a movement path.
Figure 9:
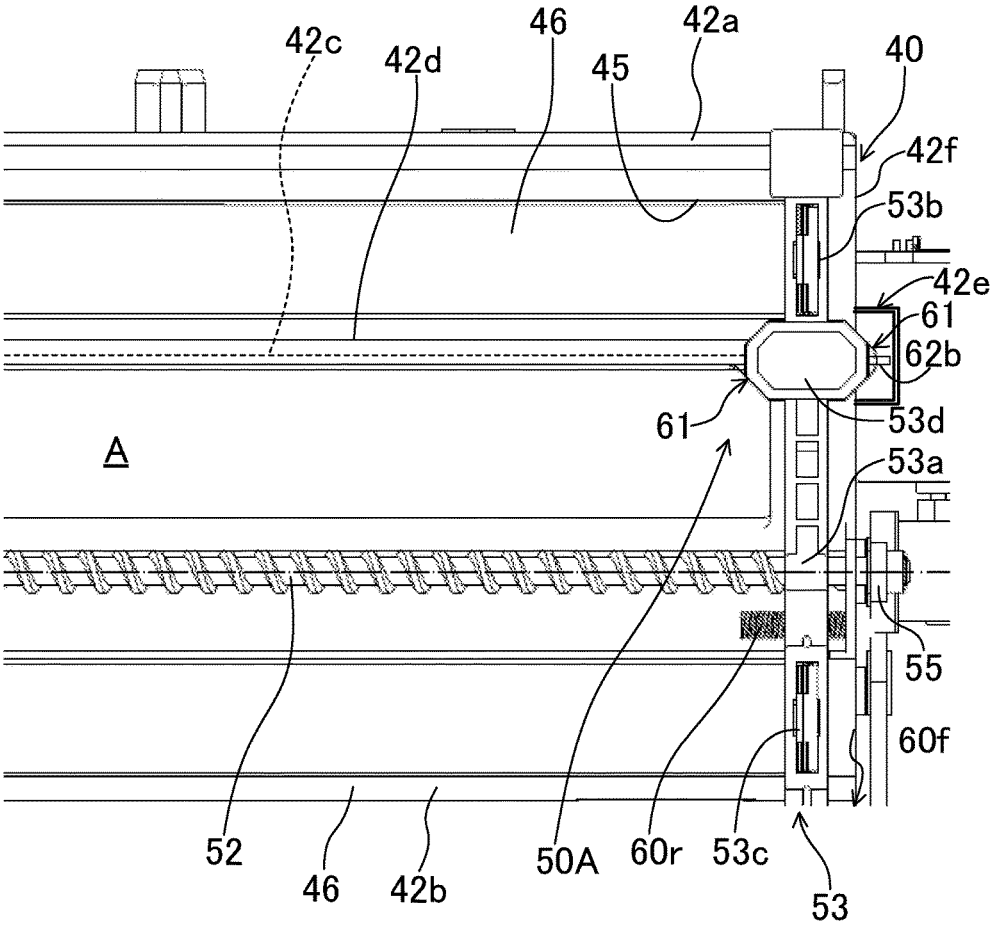

As illustrated in FIG. 8, the pair of scraper pieces 61*a* are provided at both sides of the intermediate rail part 42*c* while interposing the intermediate rail part 42*c* therebetween. Each of the scraper pieces 61*a* forms a rectangular belt shape in which its distal end edge abuts the side surface of the intermediate rail part 42*c*. In the plan view, each of the scraper pieces 61*a* is inclined with respect to the side surface of the intermediate rail part 42*c* and abuts the side surface of the intermediate rail part 42*c*. Specifically, of the two scraper members 61, one scraper member 61 which is positioned at the front side of a progress direction, has the scraper piece 61*a* configured to be inclined with respect to the side surface of the intermediate rail part 42*c* at a predetermined angle in the plan view, so that a distal end edge of the scraper piece 61*a* is positioned at the front side in the progress direction from a rear end edge of the scraper piece 61*a*. Each of the scraper pieces 61*a* is adhered and fixed to each inclined surface 53*h* of the guide part 53*d*. An inclination angle of the inclined surface 53*h* coincides with that of the scraper piece 61*a* with respect to the side surface of the intermediate rail part 42*c*.

Figure 5:
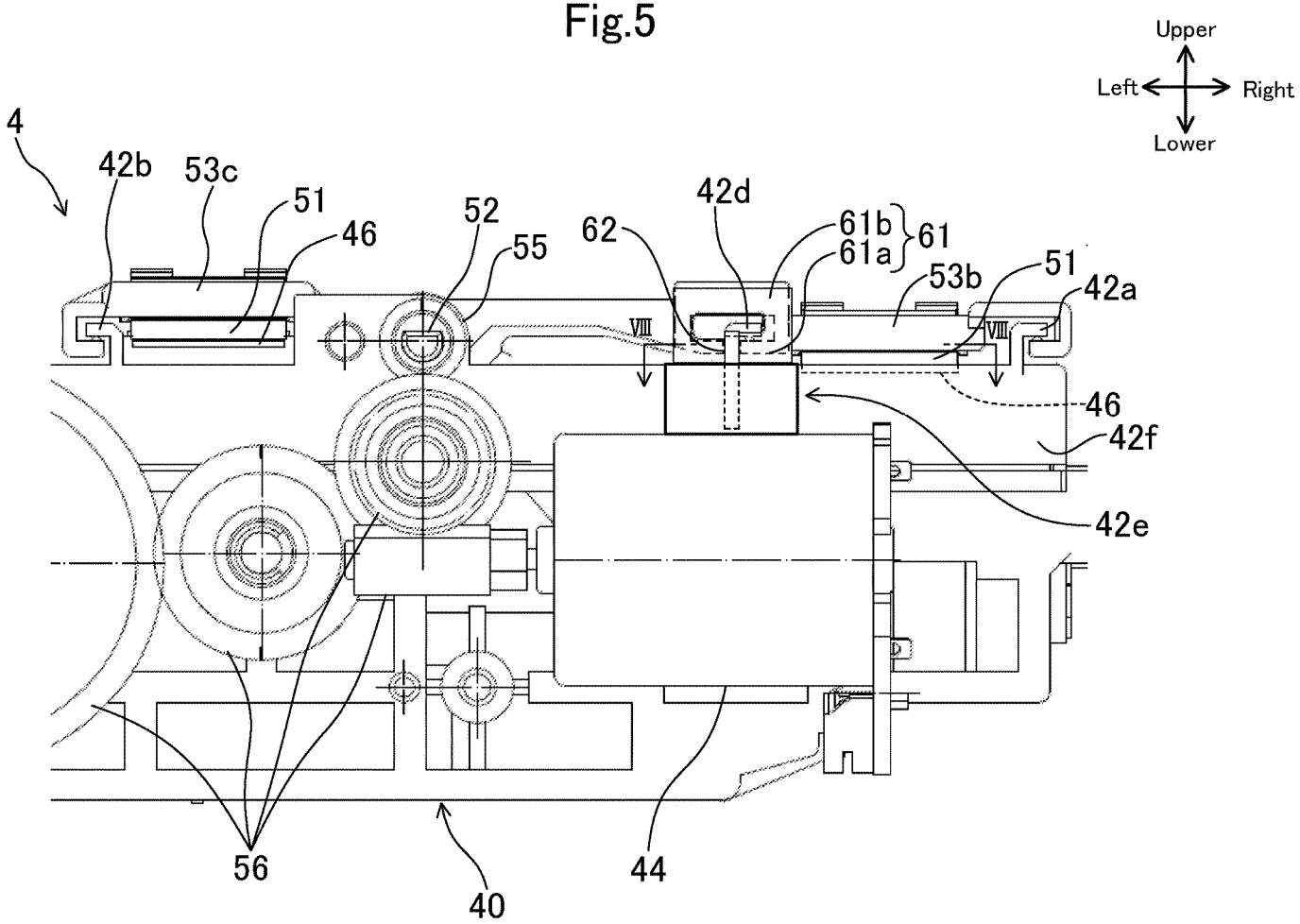
FIG. 5 is a view viewed in the arrow direction of V of FIG. 4.
Figure 6:
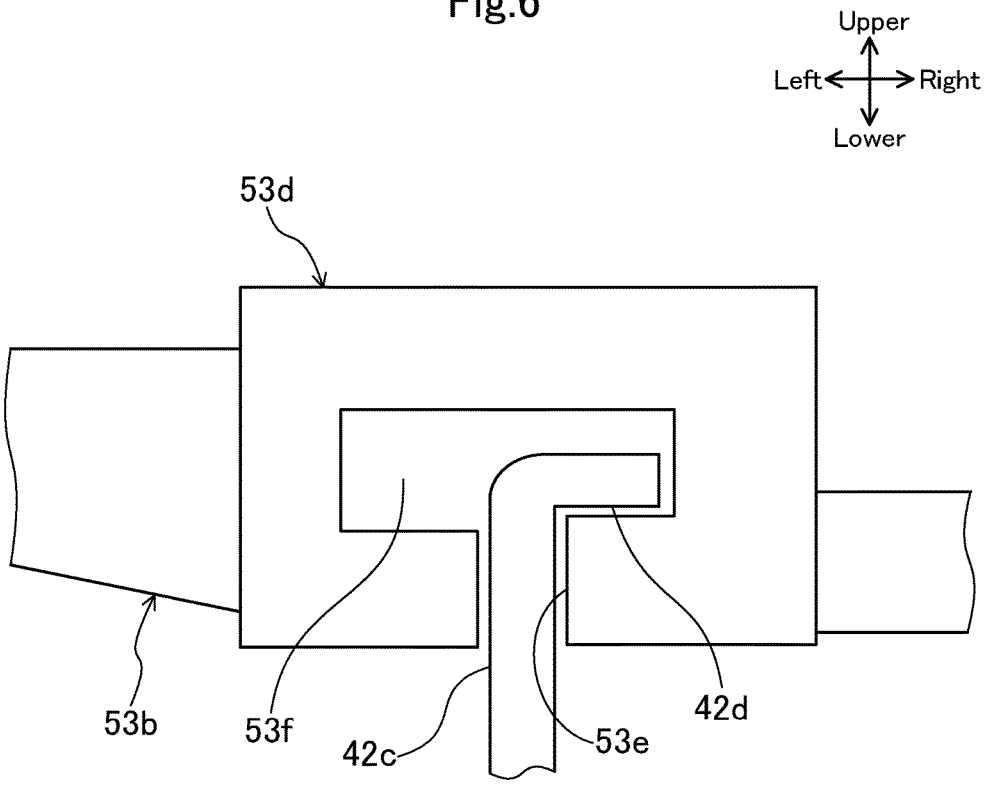
FIG. 6 is a schematic diagram illustrating a state in which an intermediate rail part is engaged with a guide part of a holding member.

The connection piece 61*b* forms a channel shape opened downward when viewed from the front and rear direction (see FIG. 5). The pair of scraper pieces 61*a* are concatenated to a lower end part of the connection piece 61*b*. The connection piece 61*b* is adhered and fixed to the vertical surface 53*g* and the pair of inclined surfaces 53*h* of the guide part 53*d* across the vertical surface 53*g* and the inclined surfaces 53*h* (see FIG. 10).

As illustrated in FIG. 7 and FIG. 9 to FIG. 11, the lid member 42 is provided on both side surfaces in the front and rear direction thereof with a removing plate 62 for removing foreign matters accumulated on the distal end edge of the scraper piece 61*a*, and the collection cases 42*e* for collecting the removed foreign matters. Each diagram illustrates only the removing plate 62 and the collection case 42*e* provided on the front side surface of the lid member 42; however, similar removing plate 62 and collection case 42*e* are also provided on the rear side surface of the lid member 42.

The removing plate 62 is arranged on the same straight line as that of the intermediate rail part 42*c* in the plan view. The removing plate 62 has a rectangular plate-like entering plate part 62*a* (corresponding to an entering part) that enters between the distal end edges of the pair of scraper pieces 61*a* when the holding member 53 has reached the moving end of the predetermined movement path A, and a support plate part 62*b* that supports the entering plate part 62*a*. Between the entering plate part 62*a* and the intermediate rail part 42*c*, a space is provided (see FIG. 11). The entering plate part 62*a* and the intermediate rail part 42*c* have the same thickness. The thickness of the entering plate part 62*a* is slightly larger than an interval of the distal end edges of both scraper pieces 61*a* when the pair of scraper pieces 61*a* are in a natural state without deflection.

Figure 10:
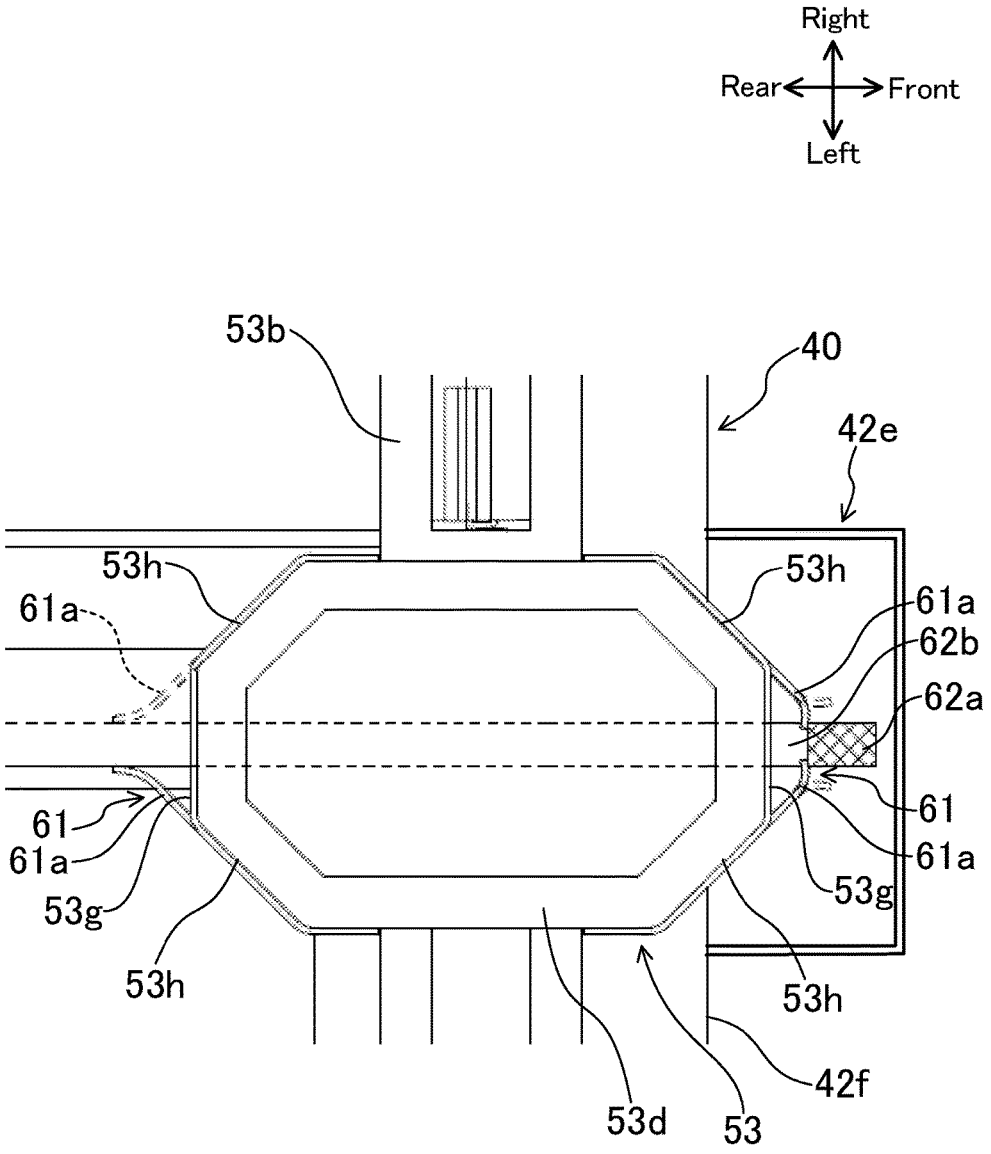
FIG. 10 is an explanation diagram for explaining an aspect in which foreign matters are removed by a removing plate when a holding member has reached a moving end of a movement path.

When the holding member 53 reaches the moving end of the movement path A, the entering plate part 62*a* of the removing plate 62 abuts the distal end edges of the pair of scraper pieces 61*a* and is pressed to the guide part 53*d* side as illustrated in FIG. 10. In this way, the distal end parts of the pair of scraper pieces 61*a* are temporarily curved and bent to the guide part 53*d* side. When the holding member 53 further advances to the moving end side, the entering plate part 62*a* enters between the distal end edges of the pair of scraper pieces 61*a*. In this case, the pair of scraper pieces 61*a* are elastically returned to a side opposite to the guide part 53*d* side by elastic restoring force. By this returning operation, foreign matters accumulated on the distal end edges of the pair of scraper pieces 61*a* are flicked away and are dropped into the collection cases 42*e*.

The collection cases 42*e* have a rectangular parallelepiped case shape opened upward. The collection cases 42*e* are integrally formed with the front side surface 42*f* and the rear side surface 42*r* (only the front side surface 42*f* is illustrated in FIG. 7 and FIG. 9 to FIG. 11) of the lid member 42. The collection case 42*e* has a rectangular shape long in the right and left direction when viewed from an upper side. In the collection case 42*e*, the aforementioned removing plate 62 is positioned at the center part of the right and left direction. The collection case 42*e* is formed to surround the removing plate 62 when viewed from an upper side. An upper end position of a sidewall of the collection case 42*e* is set to a height approximately equal to that of an upper surface of the lid member 42.

As described above, according to the optical scanning device 4 of the present embodiment, when the holding member 53 reciprocally moves along the predetermined movement path A by the rotation of the screw shaft 52, foreign matters (toner and the like) attached to both side surfaces of the intermediate rail part 42*c* are scraped off by the scraper pieces 61*a* of the scraper member 61 mounted at the holding member 53. Consequently, the foreign matters attached to both side surfaces of the intermediate rail part 42*c* can be prevented from entering into the guide groove 53*e* of the guide part 53*d* and being caught therein.

Furthermore, in the lid member 42 (a part of the housing 40), at positions of side surfaces of the holding member 53, which face the moving end side and correspond to the scraper members 61, the collection cases 42*e* are respectively provided to collect foreign matters scraped off by the scraper members 61.

According to this, when the holding member 53 has reached the moving end, foreign matters accumulated on the distal end edge of the scraper piece 61*a* are dropped into and collected in the collection cases 42*e*. Consequently, when the holding member 53 has reached the moving end, the foreign matters accumulated on the distal end edge of the scraper piece 61*a* can be prevented from being dropped from the upper surface of the housing 40 and being scattered.

Furthermore, the aforementioned scraper members 61 are mounted at both end parts of the guide part 53*d* in the movement direction of the holding member 53, wherein the scraper members 61 are arranged such that the scraper piece 61*a* of the scraper member 61, which is positioned at the front side of the progress direction at the time of the reciprocal movement of the holding member 53, is inclined with its distal end side being further in the front side than its base end side of the progress direction in the plan view.

According to this, the scraper piece 61*a* of the scraper member 61, which is positioned at the front side of the progress direction at the time of the reciprocal movement of the holding member 53, can be allowed to abut the side surface of the intermediate rail part 42*c* at an acute angle. Thus, foreign matters attached to the side surface of the intermediate rail part 42*c* can be efficiently scraped off by the scraper piece 61*a*.

Furthermore, the intermediate rail part 42*c* is provided at the outer side of both side end parts thereof in the movement direction of the holding member 53 with the entering plate part 62*a* that enters between the distal end edges of the pair of scraper pieces 61*a* when the holding member 53 reaches the moving end of the predetermined movement path A. When entering between the distal end edges of the pair of scraper pieces 61*a*, the entering plate part 62*a* is configured to press and bend the distal end parts of the scraper pieces 61*a* to the guide part 53*d* side and then to allow the distal end parts to be elastically returned to an opposite side of the guide part 53*d* side by elastic restoring force.

According to this, when the distal end parts of the scraper pieces 61*a* are elastically returned to the opposite side of the guide part 53*d* side, foreign matters are flicked away and are dropped into the collection cases 42*e*. Consequently, foreign matters accumulated on the distal end edges of the scraper pieces 61*a* can be prevented from being enlarged to enter to the guide part 53*d* side.

Furthermore, each of both side end parts of the guide part 53*d* in the movement direction of the holding member 53 has the vertical surface 53*g* formed to be vertical to the movement direction of the holding member 53 in the plan view and the pair of inclined surfaces 53*h* which are connected to both side end edges of the vertical surface 53*g* in a direction perpendicular to the movement direction and are inclined at the same angle as those of the pair of scraper pieces 61*a* in the plan view, wherein the scraper pieces 61*a* are fixed to the inclined surfaces 53*h*.

According to the configuration, the scraper pieces 61*a* are fixed to the pair of inclined surfaces 53*h*, so that the inclination angle of the scraper pieces 61*a* is adjusted to a predetermined angle and thus their distal end edges can be allowed to abut the side surface of the intermediate rail part 42*c* at an acute angle.

Furthermore, when viewed from the movement direction of the holding member 53, the scraper member 61 has the connection piece 61*b* that connects the base end parts of the pair of scraper pieces 61*a* to each other, wherein the connection piece 61*b* is fixed to the vertical surface 53*g* and the pair of inclined surfaces 53*h* across the surfaces 53*h* and 53*g* at both side end parts of the guide part 53*d*.

According to the configuration, an area of a part, in which the scraper member 61 and the holding member 53 abut each other, is increased as much as possible, so that the scraper member 61 can be firmly fixed to the holding member 53.

Furthermore, the length of the guide part 53*d* in the movement direction of the holding member 53 is longer than those of the arm parts 53*b*, 53*c* in the movement direction.

According to this, it is possible to sufficiently ensure the length of the guide groove 53*e* formed in the guide part 53*d*. Thus, it is possible to improve guide characteristics due to the guide part 53*d* (the guide groove 53*e*). Accordingly, the holding member 53 is prevented from being tilted or caused to wiggle to a small degree during movement, so that it is possible to prevent the occurrence of wiping unevenness of the transparent cover 46 due to the cleaning member 51.

Furthermore, in the optical scanning device 4 of the present embodiment, the light emitting ports 45 are provided as a pair of one set, wherein a pair of light emitting ports 45 are arranged in parallel to each other. The holding member 53 includes the nut part 53*a* fitted to and screwed with the screw shaft 52, the first arm part 53*b* extending from the nut part 53*a* to one light emitting port 45 side so as to hold the cleaning member 51, and the second arm part 53*c* extending from the nut part 53*a* to the other light emitting port 45 side so as to hold the cleaning member 51. The screw shaft 52 is arranged at a position offset to the center position in the longitudinal direction of the holding member 53 in the plan view.

In such an optical scanning device 4, since the screw shaft 52 is arranged at the position offset to the center position in the longitudinal direction of the holding member 53, when the screw shaft 52 rotates and the holding member 53 moves, balance between driving force acting on the holding member 53 by the screw shaft 52 and frictional force acting on the holding member 53 from the surface of the transparent cover 46 via the cleaning member 51 is collapsed and thus the holding member 53 is easily caused to wiggle to a small degree or is easily tilted. Thus, the configuration of the present disclosure, in which the guide part 53*d* is provided to the holding member 53, is particularly useful. In this case, employing the scraper member 61 of the present disclosure is particularly useful to prevent foreign matters from being caught during the movement of the holding member 53 (the guide part 53*d*).

MODIFICATION EXAMPLE 1

Figure 12:
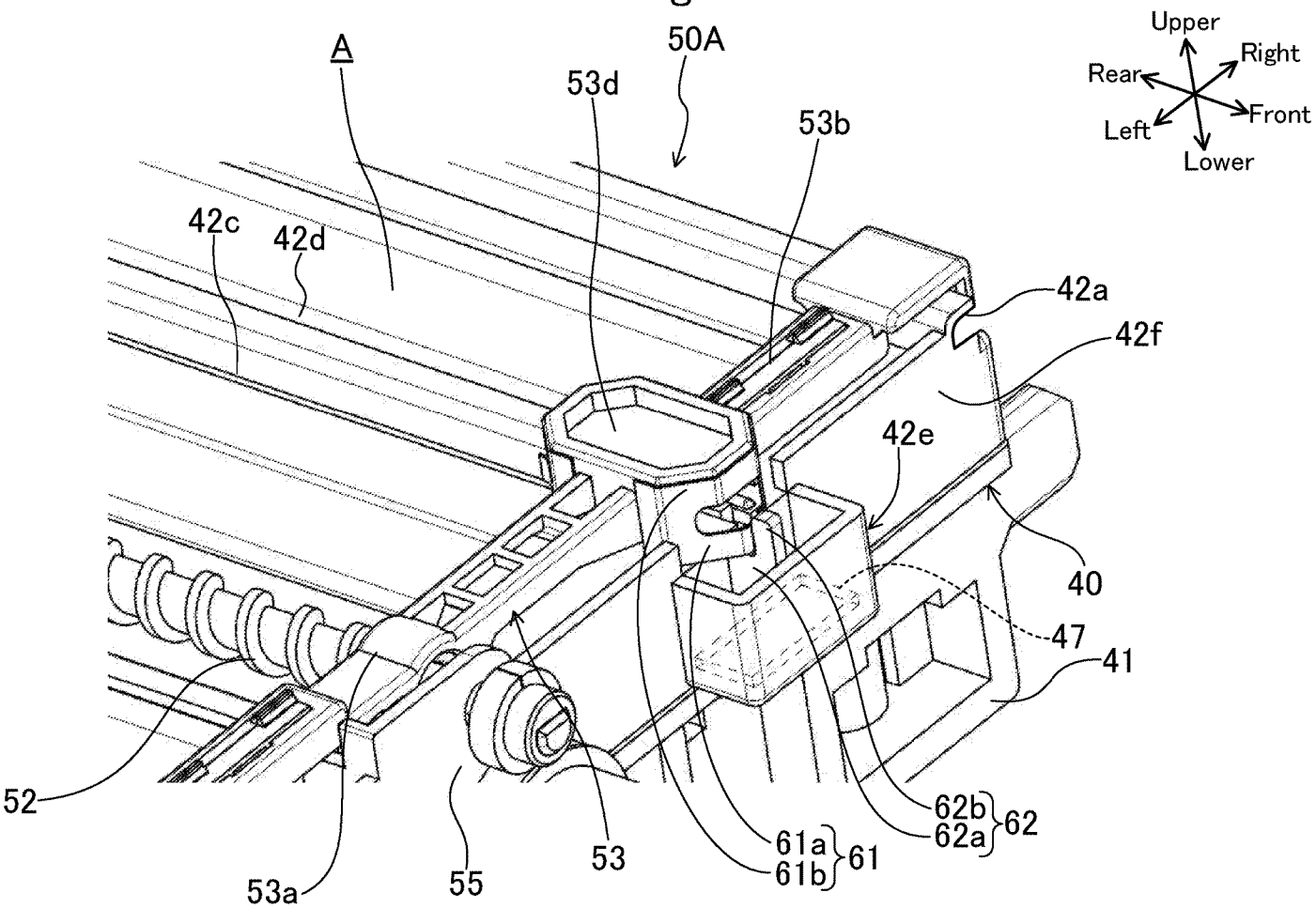
FIG. 12 is a view corresponding to FIG. 7, which illustrates a modification example 1.

FIG. 12 is a view corresponding to FIG. 7, which illustrates a modification example 1 of the aforementioned embodiment. The modification example 1 is different from the aforementioned embodiment in that a magnet 47 is arranged on a bottom surface of the collection case 42*e*. The magnet 47 has a rectangular plate shape long in the right and left direction. The magnet 47 is formed to cover approximately the whole of the bottom surface of the collection cases 42*e*. The magnet 47 corresponds to a magnetic substance that adsorbs the aforementioned magnet toner by magnet attraction force.

An example of foreign matters attached to the intermediate rail part 42*c* includes paper powder, dust, and magnet toner, which is a developer, and the like; however, among them, the magnet toner is a majority. Thus, it is important to prevent fault of peripherals due to scattering of the magnet toner.

However, in the present modification example, the magnet 47 is configured to be arranged on the bottom surface of the collection case 42*e*, so that the magnet toner, which occupies the most part of foreign matters dropped into the collection cases 42*e*, can be adsorbed to the magnet 47 by magnet attraction force and be collected.

MODIFICATION EXAMPLE 2

Figure 11:
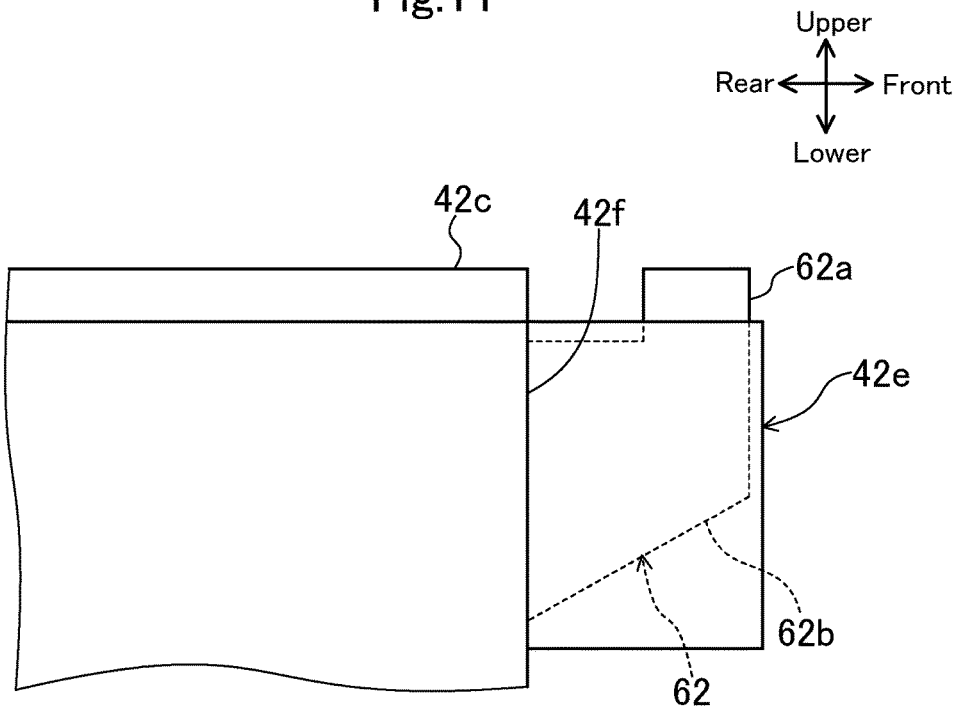
FIG. 11 is an enlarged side view illustrating the vicinity of a holding member positioned at a moving end in an optical scanning device.
Figure 13:
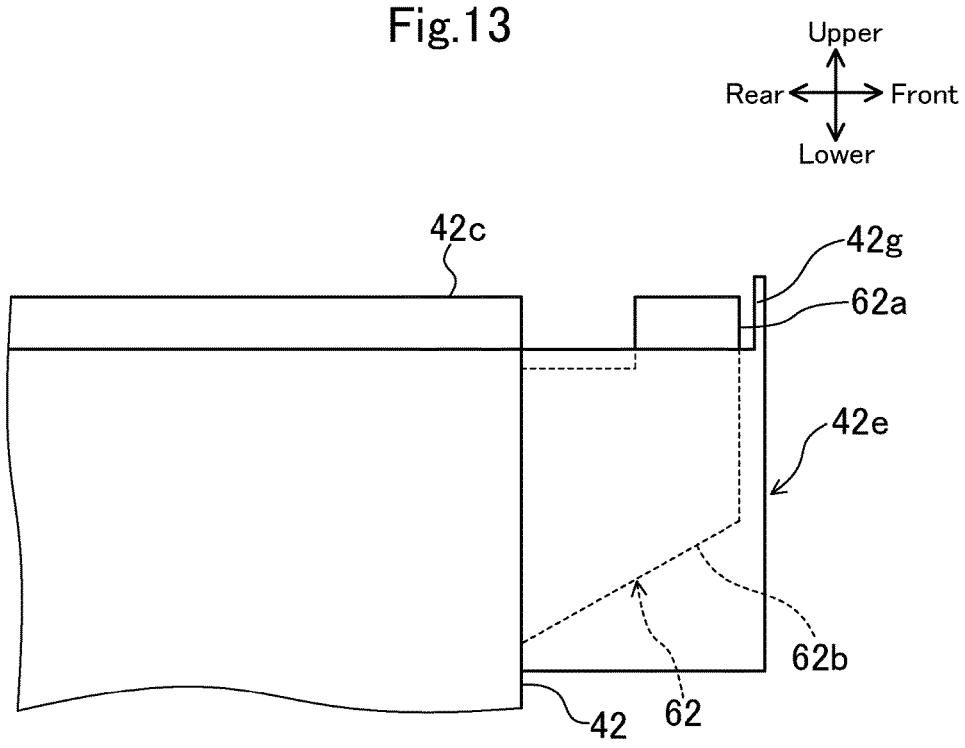
FIG. 13 is a view corresponding to FIG. 11, which illustrates a modification example 2.

FIG. 13 is a view corresponding to FIG. 11, which illustrates a modification example 2 of the aforementioned embodiment 1. The modification example 2 is different from the aforementioned embodiment 1 in terms of the shape of the collection case 42*e*.

That is, in the present modification example 2, the collection case 42*e* has an opposing wall part 42*g* opposed to the pair of scraper pieces 61*a* in the movement direction (that is, the front and rear direction) of the holding member 53. The opposing wall part 42*g* is formed over the entire right and left direction of the collection case 42*e*. A lower end of the opposing wall part 42*g* is concatenated to be level with the front sidewall of the collection case 42*e*. An upper end position of the opposing wall part 42*g* is set to a height equal to that of an upper end position of the scraper piece 61*a* (not illustrated in FIG. 13).

According to this configuration, when the holding member 53 has reached the moving end, the entering plate part 62*a* enters between the distal end edges of the pair of scraper pieces 61*a*, so that foreign matters flicked away by restoring force thereof collide with the opposing wall part 42*g* and are dropped into the collection case 42*e*. Consequently, it is possible to improve the collection capability of foreign matters by the collection case 42*e*. Furthermore, the opposing wall part 42*g* is provided to only a part (the front sidewall in the example of the drawing) of the collection case 42*e*, so that it is possible to reduce material costs as compared with a case where the upper end position of the entire sidewall of the collection case 42*e* is heightened. It is noted that the upper end position of the opposing wall part 42*g* may be positioned to be higher than that of the scraper piece 61*a*. Furthermore, the right and left walls of the collection case 42*e* may extend to a height equal to the upper end position of the opposing wall part 42*g*.

Other Embodiments

The aforementioned embodiment has described a case where a pair of light emitting ports 45 are formed in the housing 40; however, one light emitting port 45 may be formed in the housing 40.

In the aforementioned embodiment, the scraper member 61 is configured with a flexible member; however, the technology of the present disclosure is not limited thereto and the scraper member 61 may be configured with a member having no flexibility such as a fabric and a felt.

What is claimed is:

1. An optical scanning device comprising:

a housing having light emitting ports;

a transparent cover closing the light emitting ports;

a freely rotatable screw shaft extending along the transparent cover;

a cleaning member abutting a surface of the transparent cover; and a holding member having a nut part screwed with the screw shaft and arm parts extending from the nut part to hold the cleaning member, wherein the holding member is configured to reciprocally move along a predetermined movement path by rotation of the screw shaft, from an upper surface of the housing, a plate-like rail part, which extends along the screw shaft to guide movement of the holding member, protrudes, the holding member is provided with a guide part having a guide groove engaged with the rail part, and the optical scanning device further comprises:

scraper members provided to both side end parts in a movement direction in the guide part of the holding member and scraping off foreign matters attached to the rail part, wherein in the housing, at positions of side surfaces of the holding member, which face a moving end side and correspond to the scraper members, collection cases are provided to collect the foreign matters scraped off by the scraper members.

2. The optical scanning device of claim 1, wherein the collection case has a bottomed case shape opened upward, the foreign matter includes magnetic toner, and the collection case is provided at a bottom wall part thereof with a magnetic substance that adsorbs the magnet toner by magnet attraction force.

3. The optical scanning device of claim 1, wherein the scraper member has a pair of scraper pieces which are provided at both sides of the rail part while interposing the rail part therebetween, have distal end edges abutting a side surface of the rail part, and includes a flexible member, and the optical scanning device further comprises:

an entering part provided at an outer side of both side end parts of the rail part in a movement direction of the holding member and entering between the distal end edges of the pair of scraper pieces when the holding member reaches a moving end of the predetermined movement path, and wherein, when entering between the distal end edges of the pair of scraper pieces, the entering part is configured to press and bend distal end parts of the scraper pieces to a side of the guide part and then to allow the distal end parts to be elastically returned to a side opposite to the side of the guide part by elastic restoring force, the collection case has an opposing wall part opposed to the pair of scraper pieces in the movement direction of the holding member, a lower end of the collection case is concatenated to a sidewall of the collection case, and an upper end of the collection case is positioned to be level with or to be higher than upper ends of the pair of scraper pieces.

4. An image forming apparatus including the optical scanning device of claim 1.

* * * * *